United States Patent [19]

Meckler

[11] Patent Number: 4,730,461

[45] Date of Patent: Mar. 15, 1988

[54] MULTI-ZONE COLD STORAGE VARIABLE AIR VOLUME AIR CONDITIONING SYSTEM

[76] Inventor: Milton Meckler, 16348 Tupper St., Sepulveda, Calif. 91343

[21] Appl. No.: 58,408

[22] Filed: Jun. 5, 1987

[51] Int. Cl.[4] ..... F25B 29/00

[52] U.S. Cl. ..... 62/159; 62/187; 62/203; 165/2

[58] Field of Search ..... 62/187, 203, 419, 408, 62/159; 165/2

[56] References Cited

U.S. PATENT DOCUMENTS

| | | | |
|---|---|---|---|
| 2,935,857 | 5/1960 | McFarlan | 62/203 X |
| 3,996,759 | 12/1976 | Meckler | 62/238.6 |
| 4,165,036 | 8/1979 | Meckler | 62/238.6 |
| 4,270,362 | 6/1981 | Lancia et al. | 62/203 X |
| 4,419,864 | 12/1983 | McFarlan | 62/98 |
| 4,559,788 | 12/1985 | McFarlan | 62/238.6 |

*Primary Examiner*—Lloyd L. King
*Attorney, Agent, or Firm*—William H. Maxwell

[57] ABSTRACT

A multi-zone cold storage variable air volume air conditioning system for capacity effective averaging of continuously operable refrigeration cooling units of varied capacity and each operable at its optimum capacity and assigned to a separate zone space, wherein variable air volume by-pass ducts and zone dampers operate in response to zone space temperature, and characterized by a chilled water storage tank and pump circulating chilled water through a closed circuit and through a water conditioning coil, there being a downstream charging coil and an upstream re-cooling coil in the supply air duct upstream from the air conditioning coil of the cooling unit and each selectively in closed circuit through the chilled water storage tank, and control means therefor.

16 Claims, 4 Drawing Figures

HC1

MULTI-ZONE COLD STORAGE VARIABLE AIR VOLUME AIR CONDITIONING SYSTEM

BACKGROUND OF THE INVENTION

This invention relates to heating and cooling air conditioning involving a multiplicity of zones to be conditioned on a scheduled basis or continuing basis as may be required. Heretofore, full capacity heaters and cooling units have been employed for this purpose, their capacity being determined according to the zone space that is to be conditioned, and without regard to the shut-down time that is to be expected. When central air conditioning systems are employed the total of the zone space requirements must be considered and conditioning equipment adequate for the whole is normally provided, again without regard to the shut-down time which inherently occurs as conditioning requirements vary from zone to zone, and from time to time. Therefore, full capacity equipment for multi zone air conditioning has not been altogether cost effective, because the full capacity equipment cannot be operated to full capacity on a full time basis. Accordingly, it is a general object of this invention to provide a Multi-Zone Cold Storage variable Air Volume Air Conditioning System in which capacity effective averaging is employed in the selection of cooling unit capacities and in which said cooling units are operated on a full time schedule with their outputs used and/or stored as excess energy for subsequent use in the air conditioning process.

It is an object of this invention to advantageously employ a multiplicity of cooling units of the same or varied types and capacities, all selected on an installation and capacity effective basis. In accordance with this invention a capacity effective basis is the energy required to operate during a scheduled period, usually for a full day; for air conditioning with heating applied separately. A feature of this invention is the banking of excess cold water acquired by operation of the multiplicity of cooling units on a full time schedule. In practice, that schedule may be a full twenty four hour day, or preferably a lesser period in order to provide air conditioning during occupancy of the zones involved. For example, an office building occupied only during business hours need not be air conditioned throughout the off-time hours; taking into account a preconditioning period that may be desired etc. Also, conditioning requirements will vary according to season, and all of which can be adjusted for in the operation of this system.

It is an object of this invention to absorb and store excess cold water from conditioned air produced by the multiplicity of cooling units and not required at the time for zone conditioning. For example, there will be times when zone conditioning requirements are reduced, or do not exist at all. In practice, there is a chilled water storage from which the chilled condition fluid can be drawn and used for subsequent air conditioning. The chilled water-energy storage means is a closed circuit with its control and pump means with make-up means and a compression tank. Excess heat of the cooling units is dissipated either directly by a refrigerant to air condenser or is dissipated by a cooling tower.

It is an object of this invention to provide a control means whereby variable air volume flow restriction causes operation of the aforementioned chilled water storage means. With this invention, a flow sensor (pressure) at the air supply or inlet of the cooling unit determines operation of the chilled water storage means.

It is an object of this invention to provide a by-pass for the cooling unit air circulation and control means therefor whereby the cooling units operate at full capacity at all times, when the system is in operation, with all or a portion of its conditioned air delivered to the zone space, and alternately with all or a portion of its conditioned air by-passed for conservation of cold energy by the aforesaid chilled water storage means.

A widely used system for the control of supply air to the zone space being conditioned is the Variable Air-Volume (VAV) system, wherein a by-pass with a pressure responsive damper recirculates conditioned air that is restricted by zone space dampers. Aside from the aforementioned improvements in the conservation of energy by banking conditioned liquid, there is the problem of air quality which arises when employing VAV systems. That is, as and when the zone space dampers are modulated down (toward closed), the usual filtration through the return air duct becomes less effective, since the return air volume decreases, there being no air quality change through the recirculation duct. Consequently, the reduced volume of supply air is inadequately filtered and permits the quality of zone space air to deteriorate. Accordingly, it is an object of this invention to provide super-filtration of recirculation air in the Variable-Air Volume (VAV) system whereby the reduced discharge of supply air adequately improves the air quality of the zone space air, as and when the zone space dampers modulate. Air quality improvement then becomes inherent. With the present invention, there are primary and secondary air filters; a primary air filter in the return air duct, and a secondary air filter in the recirculation VAV duct. Initial one time filtration occurs through the primary filter, while repeated, partial or additional filtration occurs through the secondary filter. A higher quality filtration is thereby attained, super-filtration, for restricted discharge at reduced volume as supply air by the zone dampers.

SUMMARY OF THE INVENTION

The zones to be serviced can vary in space volume and the heating and cooling capacities will vary accordingly. That is, one heater unit or cooling unit can be of greater capacity than another, and each operable on an individual basis. There is no limit to the number of space zones to be put into or taken out of operation, however when a space zone is put into service it is operated on a full time schedule; it being understood that schedule requirements will also vary.

Each space zone cooling unit involves a refrigerant compressor, or the equivalent, directing the refrigerant through an air conditioning coil. The cooling unit heat of compression, or absorption, is either dissipated by an air cooled(i.e. refrigerant to air) condenser as in a rooftop package unit, or is absorbed by a water to refrigerant heat exchanger as in an inside water cooled air conditioning unit and then dissipated by a cooling tower. Return or intake air is from the zone space, there being a blower means that circulates the air through the air conditioning coils and to a supply air duct thermostatically controlled discharge by variable air valves or zone dampers.

There is a closed circuit water storage means for chilled water, there being valve controlled means circulating the chilled water storage through a charging or re-cooling coil in the conditioned air flow in the cooling mode.

It will be observed that chilled water is available during the continuous operation of the cooling units, and that any portion thereof not needed in the conditioning of zone space air is excess that can be and is transferred to storage in accordance with this invention. Alternately, the chilled water can then be and is retrieved for subsequent air conditioning, by recirculating it through re-cooling coils in the blower circulated air, either along or simultaneously with operation of the cooling unit (refrigeration).

It is conventional practice to employ an air filter at the supply air intake, which is done here. However, in addition thereto there is also provided an air filter in the by-pass of conditioned air in the unloading function that releases the continuous running cooling unit, when zone space air circulation is restricted or shut down partially or completely. This feature enhances air purity efficiently since it occurs in the damped air flow of the by-pass.

This system uses reduced energy while lowering peak demand through shifting required electrical energy consumption to lower cost, daily off-peak and mid-week rates. Lower installed cooling unit capacities is a major benifit, which is accomplished by pre-cooling return air from the zone space, a process that also allows the cooling unit to operate at a higher coefficient of performance (COP) in addition to increase COP benefits from continuous verses cyclic compressor (or equivalent) operation, thereby contributing to further energy savings.

Re-cooling and storage charging water coils upstream and downstream of each cooling unit evaporator coil are served from a non-insulated piping system extending to a common chilled water storage tank which is maintained at from 61° to 68° F. As a result, though each unit operates continuously during the building cooling periods, its compressor (or equivalent) is significantly down sized without sacrificing overall unit capacity. This follows, since the chilled water generated and stored by the cooling unit at a time of lower zone space demand is supplied to the upstream pre-cooling coil on demand. This is accomplished by sensibly pre-cooling the warmer (i.e. 78° to 80° F.) return air so that the down sized compressor (or equivalent) is automatically assisted in meeting its peak zone space demand at the maximum co-incident space cooling load.

A feature of this sytem is its ability to maintain humidity control independently of the elevated (i.e. 61° to 68° F.) chilled water temperature circulated to the re-cooling coils. By operating at these temperatures reduced stored chilled water volume is a result. The uncoupling of sensible and latent cooling coil requirements is made possible by operating the cooling unit direct expansion cooling coil continuously for latent load control, while the re-cooling coil operates directly in response to any net space demands for any additional sensible cooling. Since the cooling unit compressor (or equivalent) are down sized, the associated electrical distribution costs are also reduced. This together with lower maintenance cost results in significantly reduced operation cost, lower utility demand charges, and attractive utility load management incentives. Further, both the mechanical and electrical contruction trades benefit from a significantly lower first cost of installation.

Another advantage is the low cost Variable-Air-Temperature (VAT) feature which can be used in lieu of a VAV operating mode when desired, permitting close control of individual zone spaces served from the same cooling unit. This feature permits superior operation as compared with higher cost centralized Variable-Air-Volume (VAV) or dual duct systems, and without the annoying terminal part load noise variation characteristics of such centrally distributed air handling systems. And, by banking the excess cooling capacity of the multiplicity of cooling units combined in this composite system operating under light load, and passing excess to the chilled water storage tank, actual installed refrigeration cooling capacity is substantially reduced yet automatically shared with other cooling units at the peak cooling time returned for later use in meeting individual cooling unit zone space cooling demands, while delivering high system comfort performance standards at affordable cost. In addition, should any one cooling unit fail, at least some cooling effect to its zone space is assured through the operation of that unit's recooling coil, as will be described.

The foregoing and various other objects and features of this invention will be apparent and fully understood from the following detailed description of the typical preferred forms and applications thereof, throughout which description reference is made to the accompanying drawings.

THE DRAWINGS

FIG. 1 is a view of one heating and cooling unit and the zone space serviced thereby, as related to the storage of cold water.

FIG. 2 is a schematic view illustrating the multi unit system as it is comprised of dissimilar heating and cooling units, and each serving a designated zone space; a second floor with rooftop heating and cooling units, and inside heating and cooling units and a cooling unit, and a first floor with an inside cooling unit and a separate heating unit. It is to be understood that the rooftop units service either or both floors.

PREFERRED EMBODIMENT

Figure 2:
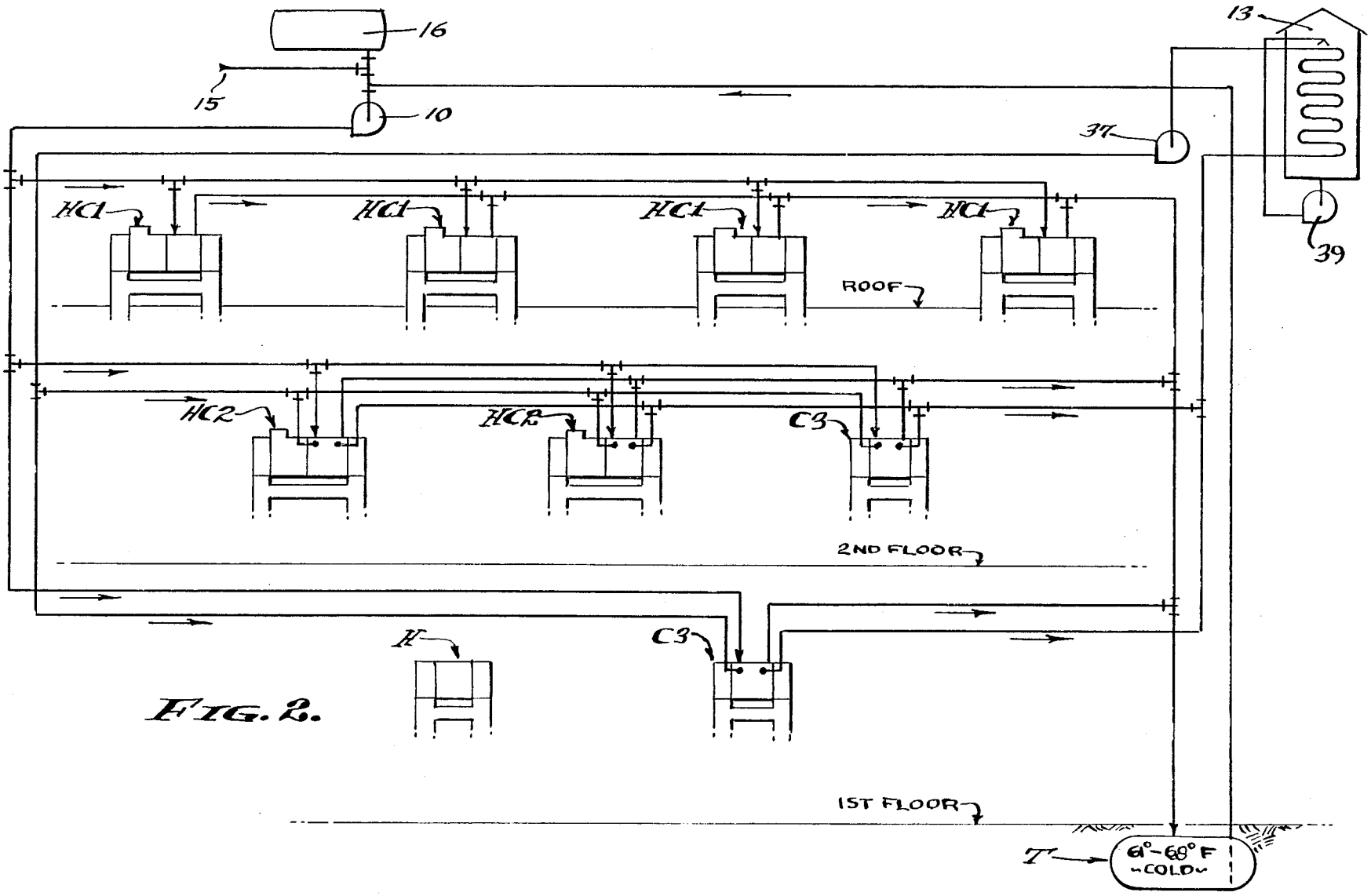

Referring now to the drawings, this is a Multi-Zone Variable Air Volume Air Conditioning System that features a multiplicity of down-sized air cooling units. As shown, there are heating and cooling units HC1, heating and cooling units HC2, and cooling units C3, each serving a zone space to be air conditioned. Each air cooling unit operates on an individual basis to cool its associated zone space, as set by its occupants. The heating means of each unit operates independently upon demand to heat the zone space with which it is associated. There may be individual furnaces in units HC1 and HC2, or separate heaters H as shown in FIG. 2, preferably gas fired furnaces or heaters.

Any excess cooling generated by any one or more of the cooling units HC1, HC2 or C3 is absorbed by a charging coil C placed therein downstream of its air handling coil A (operating as an evaporator). The charging coil C is in a closed circuit water source to a chilled water storage tank T, it being a primary object of this invention to store excess chilled water as and when it becomes available, for subsequent use in recooling coil R placed in the cooling unit upstream of its air handling coil A. The re-cooling coil R is also in the closed chilling water circuit, the chilled water from storage tank T being circulated by a pump 10 through either coil C or coil R. The chilled water source is supplied with make-up water at 15 and protected by a compression tank 16.

The multiplicity of zone spaces will vary according to building requirements. For example and as shown, a two level building is serviced with a heating and cooling unit or a cooling unit alone for each separate zone space; a cooling capacity, also a heating capacity when required, being selected for each zone space according to its requirements. Therefore, the number of cooling units per building or a floor or level thereof will vary, as well as the capacity of such units.

Figure 3:
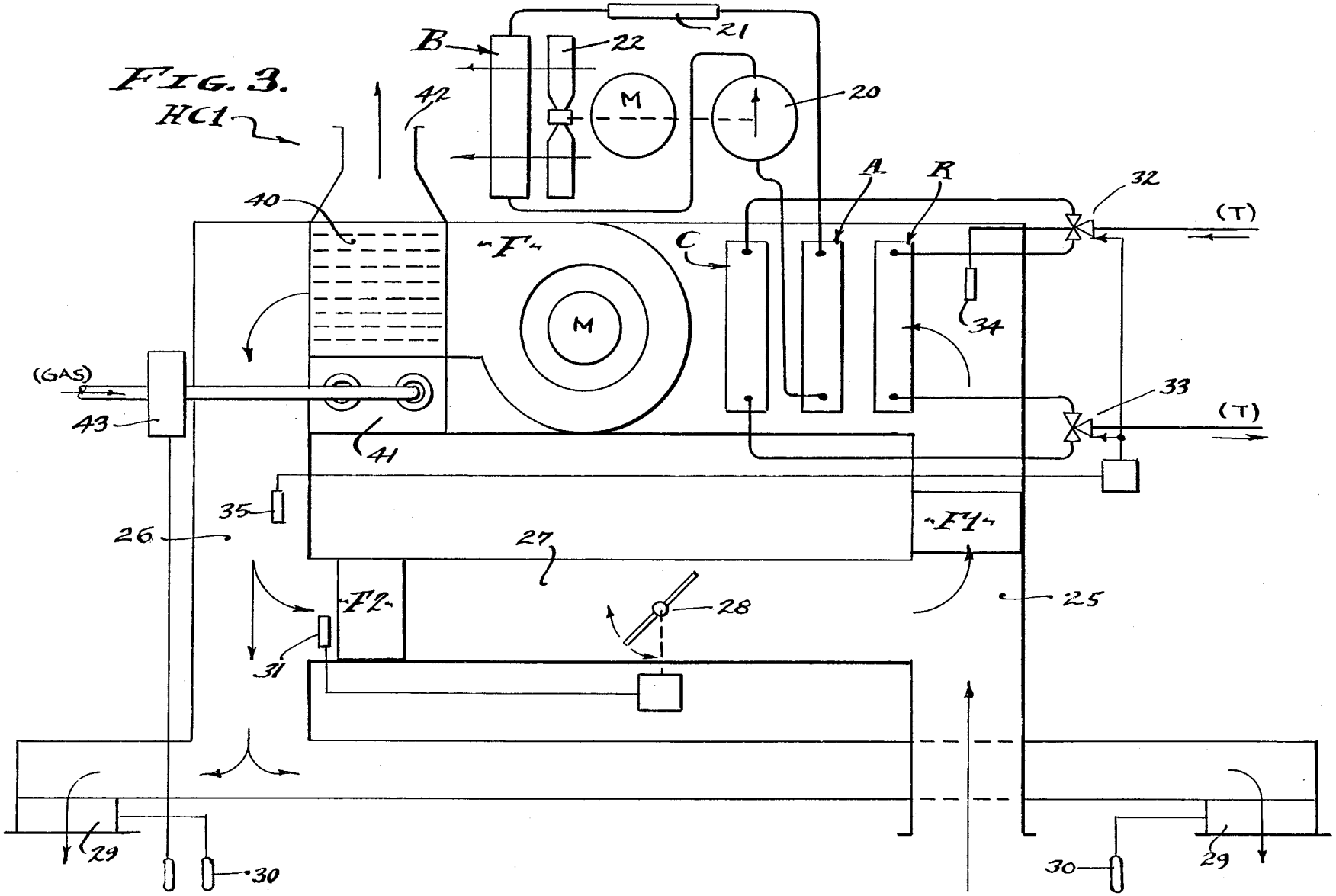
FIG. 3 is a schematic view of one of the heating and cooling units and its ducting into the zone space, and illustrating the charging and recooling coils that are in closed circuit with cold water storage.

Referring now to FIG. 3 of the drawings, the outside heating and cooling units HC1 (rooftop) are alike and each includes the following components and operates as follows in the cooling mode: The refrigeration system of the unit is operated continuously by a motor M, and directs the flow of hot refrigerant gas from a compressor 20 to the coil B (condenser) so that the heat of compression is dissipated to atmosphere by a fan 22. This liquid refrigerant is then directed through an expansion device, such as a capillary at 21, and enters the air handling coil A as a low pressure liquid. This low pressure liquid boils, becomes a vapor and absorbs heat from the supply air circulated by a blower F. The refrigerant is then returned into the compressor, completing the cooling cycle. It is to be understood that the refrigeration section can be of any type, for example operated by gas.

Figure 1:
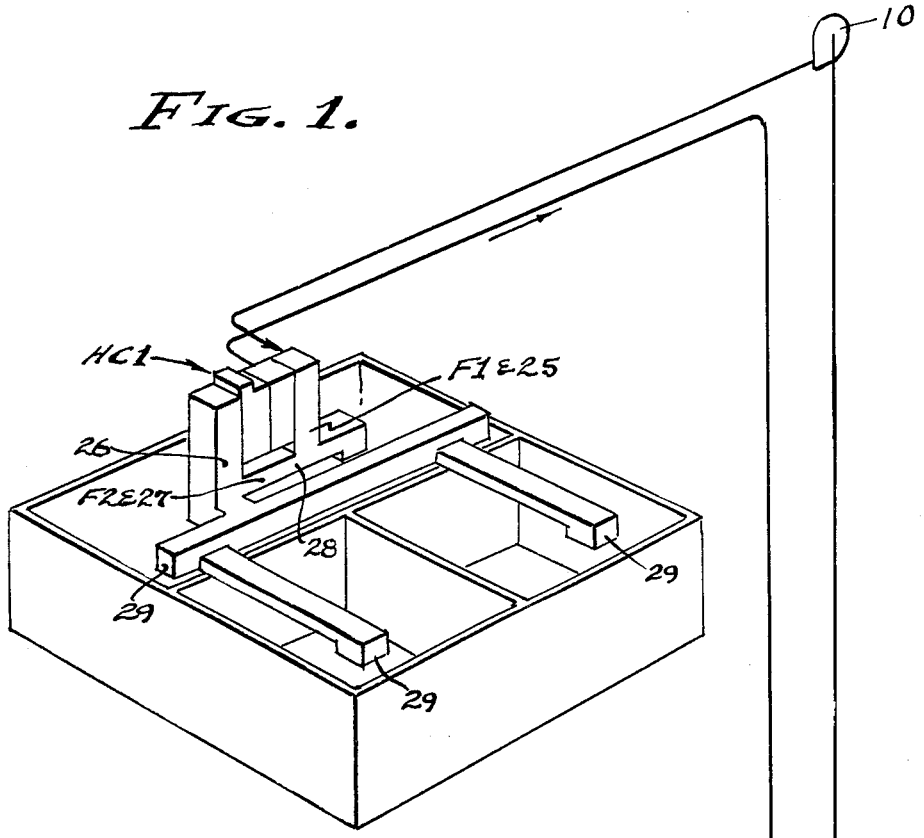
Figure 4:
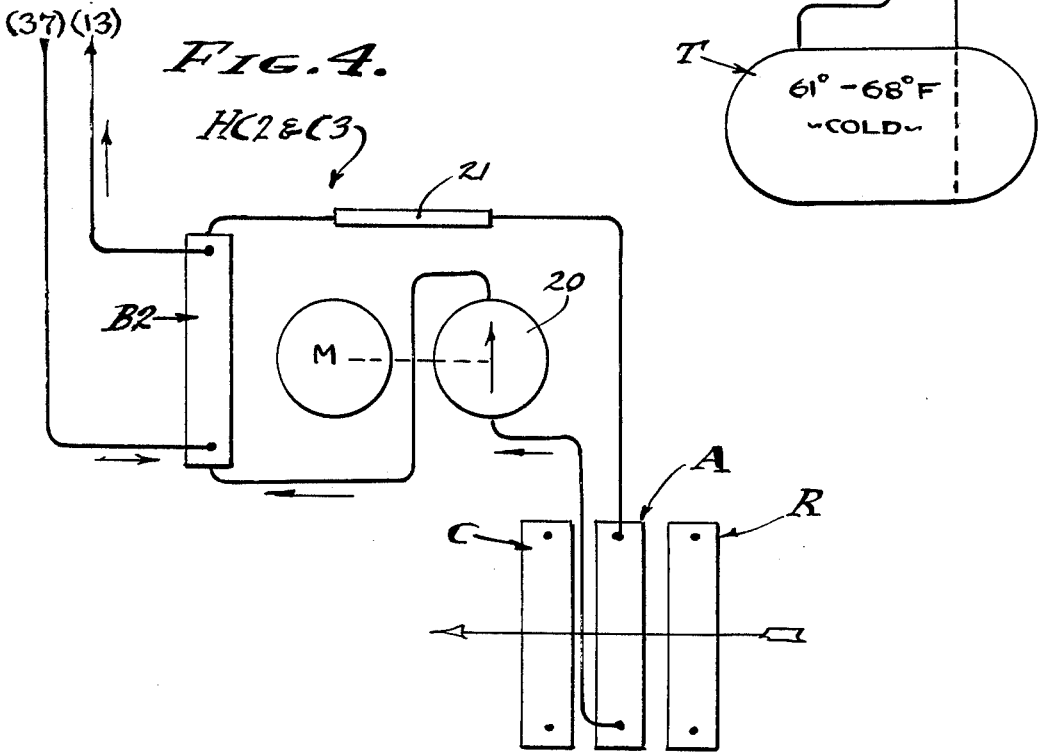
FIG. 4 is a schematic view similar to a portion of FIG. 3, showing an inside water cooled air cooling unit dissipating heat through a heat exchanger.

Referring now to FIG. 4 of the drawings, the inside water heating and cooling units HC2 and the cooling units C3 operate the same as units HC1 above described, except that the heat of compression is dissipated by a heat exchanger B2 (condenser). The heat exchanger, or exchangers, B2 are in a closed circuit to a cooling tower 13 and the water circulated by a pump 37. A pump 39 circulates the tower chilling water for evaporative cooling through control means not shown, as and when required. Accordingly, heat of compression is dissipated from the inside cooling units without adversely affecting the air conditioning processes.

The conditioned air circulated through the charging coil C is normally in the range of 50° to 60° F. and absorbs heat from the chilled water source pumped therethrough, so that the chilled water storage tank T is maintained within the useful 60° to 70° range for precooling of mixed return and outdoor ventilation air.

In accordance with this invention, each zone space refrigeration section of units HC1, HC2 and C3 is essentially the same, except perhaps in its capacity. That is, each has a blower F with an air intake duct 25 and an air supply duct 26. The air handling coil A is in the intake duct 25, with the charging coil C adjacent to and downstream of the coil A, and the re-cooling coil R adjacent to and upstream of the coil A. Intermediate the intake air duct 25 and supply air duct 26 there is a by-pass duct 27 in which there is a variable air volume damper means 28. The by-pass duct 27 is provided to re-circulate conditioned blower air from the supply duct 26 into the intake duct 25, proportionately as is required according to the restriction imposed by zone space dampers 29. In practice, the zone space dampers 29 may partially or completely restrict the supply air flow from the cooling unit, according to control by a space thermostat that modulates the dampers 29 between opened and closed conditions. It is to be understood that each cooling unit may serve one or a plurality of zones, each zone being defined for the purposes of this invention as having its temperature controlled from a separate space thermostat 30. Accordingly, the dampers 29 are modulated by space thermostats 30, and when cooling demand is high the respective zone variable air volume damper 29 will open, in which condition the by-pass damper means 28 modulates closed. The opening and closing of dampers 28 and 29 is complementary and variable, and vise versa, as required. Therefore, a pressure responsive means 31 is provided to sense supply air pressure and to commensurately modulate the by-pass damper means 28, as stated above.

In accordance with this invention, each zone space heating and cooling unit HC1 and HC2 includes a furnace or heater means (a section) through which the intake air from duct 25 is delivered by the blower F through a heat exchanger 40 that transfers heat from combustion gases rising from burners 41 and discharged through a flue 42. The burners 41 are controlled by thermostat means 43, in a manner common to the state of the art. It is to be understood that the burners 41 may be electrical or of any other form. Zoning is arranged such that on simulataneous demands for heating and cooling, space thermostats interconnected with a heating or cooling unit HC1 or HC2 serve their respective zone spaces. Cooling-only air conditioning units, i.e. without heaters (not shown), also conserve interior building zones and operate in the manner described above.

Also, in order to ensure a savings in fan operating energy use, pressure means 31 also causes variable speed supply means of the fan motor to increase or reduce its speed of operation depending upon net space demands for cooling and heating. The water source charging coil C and re-cooling coil R are temperature controlled according to the mode of operation, cooling or heating. In the heating mode the charging coil C and recooling coil R are closed to water source circulation. However, in the cooling mode the charging coil C is opened to the storage tank T through valves 32 and 33 when the zone space cooling requirements are met and the closed modulation of the zone dampers 29 causes open modulation of the by-pass damper means 28, and the recirculation of cooled conditioned air. Thus, excess cooling is absorbed by the charging coil C and the chilled water source is cooled thereby and pumped into the chilled water storage tank T by pump 10. Valves 32 and 33 and pump 10 are responsive to a temperature sensor 34 in the intake duct 25, to sense the admixed and recirclated air, activating the chilled water source and the charging coil C when the intake air (whether mixed or not) is sufficiently cool or unload so as to permit the excess cooling capacity of the downsized compressor to be stored in tank T1 of the chilled water source.

It is to be understood that all cooling unit compressors are controlled by the temperature in the chilled water tank T, unless any one space thermostat 30 switches to a net demand for heating, at which time such control is automatically transfered for that unit compressor only, to the action of any one space thermostat calling for heating. All other unit compressors operate to assure that the chilled water storage tank T is always below a preset low temperature (i.e. 68°). When that low limit in the storage tank is reached, all remaining unit compressors are automatically switched to the control of their respective zone thermostats 30, in the manner hereinabove described, but also respond under the circumstance of a chilled water tank at a predetermined low limit to any net space (i.e. zone) demand for cooling on a per zone basis, by applying both coils A and C for charging chilled water tank T1 with available net excess cooling capacity of the continuously operating heat pump, compressor.

The chilled water source is reclaimed from the storage tank T by the re-cooling coil R through valves 32 and 33 when zone space cooling is not met by the cooling unit and its air handling coil A, and the opened modulation of the zone space dampers 29 causes closed modulation of the by-pass damper means 28, and the reduction or stopping of recirculated cooled conditioned air. Thus, there can be no excess cooling and to the contrary there arises a necessity to assist the downsized cooling unit. Accordingly, the valves 32 and 33 and pump 10 are responsive to a temperature sensor 35 in the supply air duct 26, to sense the supply air temperature when it is insufficiently cooled and requires greater heat absorption than capable of the cooling unit and its air handling coil A, and thereby activating the chilled water source and the re-cooling coil R to assist the cooling unit with the chilled water source from storage tank T.

Referring now to air quality, in addition to the usual air filter in the return air intake duct, there is also an air filter in the air re-circulation by-pass duct of the Variable-Air-Volume (VAV) system. As shown, there is a primary air filter F1 in the air intake duct 25 ahead of the commingling therein of the recirculation air, and there is a secondary air filter F2 in the by-pass duct 27 preferably ahead of the air volume damper means 28. Said placement of the primary and secondary filters is significant, making it advantageous to place the more effective primary filter F1 for its one-time processing of return air, while the lesser effective secondary filter F2 is of a capacity for processing the reduced volume of recycled air. In practice, the pressure sensor 31 is placed ahead of the secondary filter F2 in order to sense variable pressure in the ducts 26 and 27, to control the variable volume damper means 28.

In carrying out this invention, there is necessarily a resistance to the flow of air through duct 27 by the damper means 28, and this resistance is preceeded by the air flow resistance of the secondary filter F2, inherent in the function of its normal filtration effect. Therefore, the restrictive effect of damper means 28 is commensurately reduced at the outset, adding to improved energy efficient in filtration and recirculation when the zone space damper 28 is modulated open. Therefore, the recycling of air on a continuous basis through the secondary filter F2 has no adverse effect upon the primary filter F1 which continues to filter the return air on demand as controlled by the zone space damper 29, and has no operating cost penalty since the available pressure differential between supply and return ducts provides the means to cause this recycled air to flow through filter F2 while said filter F2 inherently serves to restrict the air flow through duct 27. The flow restriction of filter F2 preceeds the by-pass damper means 28, and it provides a portion of the necessary flow resistance and thereby partially balances the system so that the damper means 28 then trims and/or adjusts for the filter F2 loading. It is significant that the recycled air through duct 27 and into the air supply duct 26 is repeatedly processed, or partially so, and that the quality of purification is intensified and results in super-purification of the reduced air supply to the conditioned space.

From the foregoing it will be understood that I have provided a simple and direct approach and solutions to the matters of efficiency of air conditioning, applied on the basis of zone space requirements and determinable periods of service. Capacity effective averaging is employed which permits the use of equipment having reduced conditioning capacity, together with recycled filtration of supply air which intensifies the quality of zone space air when flow is restricted by zone space damping. This invention also makes possible the employment of refrigeration cooling units varying widely in capacity and use, and to operate them at the convenience of the occupants of separated zone spaces, while over production of cold water is stored for subsequent or simultaneous use in any one of the cooling units that may require supplemental energy for cooling.

Having described only the typical preferred forms and applications of my invention, I do not wish to be limited or rectricted to the specific details herein set forth, but wish to reserve to myself any modifications or variations that may appear to those skilled in the art as set forth within the limits of the following claims.

I claim:

1. A multi-zone thermal energy storage variable air volume air conditioning system for capacity effective averaging in the selection of a multiplicity of continuously operable refrigeration cooling units that may vary in capacity and each operable at its optimum capacity and assigned to a separate zone space, and including:

a plurality of zone space cooling units and each comprising a refrigeration means directing refrigerant through a condenser and through an air conditioning coil, an air intake duct from the assigned zone space delivering return air from the zone space and through the air conditioning coil, a supply air duct delivering conditioned air into the zone space from the air conditioning coil, and blower means driving air through said ducts, a variable air volume by-pass duct from the supply air duct to the intake air duct and with air volume damper means responsive to air pressure in the supply air duct, a zone space damper means at the discharge of the supply air duct into the zone space, a chilled water storage tank with pump means circulating the chilled water through a closed circuit.

a charging coil in the supply air duct downstream from the air conditioning coil and a recooling coil in the supply air duct upstream from the air conditioning coil and each selectively in closed circuit by valve means through the chilled water storage tank, and control means responsive to duct air temperature to open said valve means from the chilled water storage tank and its closed circuit through the charging coil for chilled water storage when excess cooling is available downstream of the air conditioning coil, and alternately to open said valve means from the chilled water storage tank through its closed circuit through the re-cooling coil for cooling when return air temperature in the intake air duct is excessive.

2. The thermal energy storage air conditioning system as set forth in claim 1, wherein the control means is responsive to chilled water storage tank temperature to maintain the required supply temperature of said chilled water.

3. The thermal energy storage air conditioning system as set forth in claim 1, wherein the control means is responsive to chilled water storage tank temperature to maintain the required supply temperature of said chilled water at 61° to 68° F.

4. The thermal energy storage air conditioning system as set forth in claim 1, wherein at least one of the zone space cooling units is an outside unit and its condenser dissipating heat of compression-absorption into the atmosphere.

5. The thermal energy storage air conditioning system as set forth in claim 1, wherein at least one of the zone space cooling units is an outside unit and with fan means directing air through its condenser dissipating heat of compression-absorption into the atmosphere.

6. The thermal energy storage air conditioning system as set forth in claim 1, wherein a cooling tower with pump means circulates cooling water through a closed circuit, and wherein at least one of the zone space cooling units is an inside water cooled unit with its condenser in the form of a heat exchanger dissipating heat of compression-absorption into the closed circuit cooling tower water circulated by its pump means.

7. The thermal energy storage air conditioning system as set forth in claim 1, wherein there is a primary air filter in the intake duct to the air conditioning coil, and wherein there is a secondary air filter in the by-pass duct from the supply air duct commensurately restrictive with the restrictive effect of the air volume damper means, for intensified air filtration.

8. The thermal energy storage air conditioning system as set forth in claim 1, wherein there is a primary air filter in the intake duct between the by-pass duct opening therein and the air conditioning coil, and wherein there is a secondary air filter in the by-pass duct from the supply air duct commensurately restrictive with the restrictive effect of the air volume damper means, for intensified air filtration.

9. A multi-zone thermal energy storage variable air volume heating and cooling air conditioning sytem for capacity effective averaging in the selection of a multiplicity of continuously operable refrigeration cooling units that may vary in capacity and each operable at its optimum capacity and assigned to a separate zone space, and including:

a plurality of zone space heating and cooling units and each comprising a heating means and a refrigeration means between common supply and return air ducts, the refrigeration means directing refrigerant through a condenser and through an air conditioning coil, an air intake duct from the assigned zone space delivering return air from the zone space and through the air conditioning coil, a supply air duct delivering conditioned air into the zone space from the air conditioning coil, and blower means driving air through said ducts, a variable air volume by-pass duct from the supply air duct to the intake air duct and with air volume damper means responsive to air pressure in the supply air duct, a zone space damper means at the discharge of the supply air duct into the zone space, a chilled water storage tank with pump means circulating the chilled water through a closed circuit, a charging coil in the supply air duct downstream from the air conditioning coil and a recooling coil in the supply air duct upstream from the air conditioning coil and each selectively in closed circuit by valve means through the chilled water storage tank, control means responsive to zone space temperature to operate the heating means below a selected temperature, and control means responsive to duct air temperature to open said valve means from the chilled water storage tank and its closed circuit through the charging coil for chilled water storage when excess cooling is available downstream of the air conditioning coil, and alternately to open said valve means from the chilled water storage tank through its closed circuit through the re-cooling coil for cooling when return air temperatrue in the intake air duct is excessive.

10. The thermal energy storage air conditioning system as set forth in claim 9, wherein the control means is repsonsive to chilled water storage tank temperature to maintain the required supply temperature of said chilled water.

11. The thermal energy storage air conditioning system as set forth in claim 9, wherein the control means is responsive to chilled water storage tank temperature to maintain the required supply temperature of said chilled water at 61° to 68° F.

12. The thermal energy storage air conditioning system as set forth in claim 9, wherein at least one of the zone space cooling units is an outside unit and its condenser dissipating heat of compression-absorption into the atmosphere.

13. The thermal energy storage air conditioning system as set forth in claim 9, wherein at least one of the zone space cooling units is an outside unit and with fan means directing air through its condenser dissipating heat of compression-absorption into the atmosphere.

14. The thermal energy storage air conditioning system as set forth in claim 9, wherein a cooling tower with pump means circulates cooling water through a closed circuit, and wherein at least one of the zone space cooling units is an inside water cooled unit with its condenser in the form of a heat exchanger dissipating heat of compression-absorption into the closed circuit cooling tower water circulated by its pump means.

15. The thermal energy storage air conditioning system as set forth in claim 9, wherein there is a primary air filter in the intake duct to the air conditioning coil, and wherein there is a secondary air filter in the by-pass duct from the supply air duct commensurately restrictive with the restrictive effect of the air volume damper means, for intensified air filtration.

16. The thermal energy storage air conditioning system as set forth in claim 9, wherein there is a primary air filter in the intake duct between the by-pass duct opening therein and the air conditioning coil, and wherein there is a secondary air filter in the by-pass duct from the supply air duct commensurately restrictive with the restrictive effect of the air volume damper means, for intensified air filtration.

* * * * *

UNITED STATES PATENT AND TRADEMARK OFFICE

CERTIFICATE OF CORRECTION

PATENT NO. : 4,730,461

DATED : Mar. 15, 1988

INVENTOR(S) : MILTON MECKLER

It is certified that error appears in the above—identified patent and that said Letters Patent is hereby corrected as shown below:

IN THE SPECIFICATION:

Col. 2 line 38 change "the" to --both the primary and--. Col. 3 line 26 change "week" to --peak--. Col. 4 line 16 before "returned" insert --and--. Col. 6 line 32 change "conserve" to --can serve--. Col. 6 line 57 change "unload" to --unloaded--. Col. 7 line 39 delete "one-time".

IN THE CLAIMS:

Col. 9 line 45 change "sytem" to --system--. Col. 10 line 26 change "repsonsive" to --responsive--.

Signed and Sealed this

Sixteenth Day of August, 1988

*Attest:*

*Attesting Officer*

DONALD J. QUIGG

*Commissioner of Patents and Trademarks*